US005505343A

United States Patent [19]

Knickerbocker

[11] Patent Number: 5,505,343

[45] Date of Patent: Apr. 9, 1996

[54] MANUALLY ACTUATED PUMP

[76] Inventor: Michael G. Knickerbocker, 4516 Hillside Ct., Crystal Lake, Ill. 60012

[21] Appl. No.: 326,705

[22] Filed: Oct. 19, 1994

[51] Int. Cl.[6] ..... B67D 5/32

[52] U.S. Cl. ..... 222/321.1; 222/321.2; 222/321.8

[58] Field of Search ..... 222/321.1, 321.2, 222/321.7, 321.9, 380; 239/333

[56] References Cited

U.S. PATENT DOCUMENTS

| | | |
|---|---|---|
| 2,880,914 | 4/1959 | Lerner et al. . |
| 3,146,920 | 9/1964 | Benjamin . |
| 3,237,571 | 3/1966 | Corsette . |
| 3,249,259 | 5/1966 | Corsette . |
| 4,025,046 | 5/1977 | Boris . |
| 4,046,495 | 9/1977 | Grimm, Jr. . |
| 4,057,176 | 11/1977 | Horvath . |
| 4,144,987 | 3/1979 | Kishi . |
| 4,154,374 | 5/1979 | Kirk, Jr. . |
| 4,173,297 | 11/1979 | Pettersen . |
| 4,183,449 | 1/1980 | Blake . |
| 4,243,157 | 1/1981 | Spatz . |
| 4,271,990 | 6/1981 | Kutik et al. . |
| 4,272,228 | 6/1981 | Kutik et al. . |
| 4,278,189 | 7/1981 | Kirk, Jr. . |
| 4,305,530 | 12/1981 | Nozawa ..... 222/321.2 |
| 4,317,531 | 3/1982 | Saito et al. . |
| 4,345,718 | 8/1982 | Horvath . |
| 4,365,729 | 12/1982 | Saito et al. . |
| 4,402,432 | 9/1983 | Corsette . |
| 4,410,107 | 10/1983 | Corsette . |
| 4,458,832 | 7/1984 | Corsette . |
| 4,494,680 | 1/1985 | Corsette . |
| 4,503,996 | 3/1985 | Sorm et al. . |
| 4,503,997 | 3/1985 | Corsette . |
| 4,511,065 | 4/1985 | Corsette . |
| 4,591,077 | 5/1986 | Corsette . |
| 4,596,344 | 6/1986 | Corsette . |
| 4,606,479 | 8/1986 | Van Brocklin . |
| 4,640,443 | 2/1987 | Corsette . |
| 4,669,664 | 6/1987 | Garneau . |
| 4,823,991 | 4/1989 | Skorka . |
| 4,960,230 | 10/1990 | Marelli . |
| 4,984,702 | 1/1991 | Pierport . |
| 5,064,105 | 11/1991 | Montaner . |
| 5,147,073 | 9/1992 | Catee . |
| 5,192,006 | 3/1993 | Van Brocklin et al. . |

FOREIGN PATENT DOCUMENTS

| | | | |
|---|---|---|---|
| 0286925 | 10/1988 | European Pat. Off. ..... | 222/321.9 |
| 2179406 | 3/1987 | United Kingdom ..... | 222/321.7 |

*Primary Examiner*—Karen B. Merritt
*Assistant Examiner*—Kenneth Bomberg

[57] ABSTRACT

An improved manually actuated pump is disclosed for dispensing a volume of liquid from a container comprising a body having a cylindrical body surface. A piston is disposed within the body for slidably sealing with the cylindrical body surface to define a pump chamber with at least a portion of the piston being disposed external to the body defining a piston stem having a stem passage extending therethrough. A spring biases the piston into an extended position. An induction tube is received within a duct conduit for providing fluid communication between the liquid within the container and the pump chamber. A first one-way valve enables the flow of the liquid only from the container into the pump chamber whereas a second one-way valve enables the flow of the liquid only from the pump chamber into the stem passage. An actuator having a terminal orifice communicates with the stem passage for discharging a volume of the liquid from the container through the terminal orifice upon a longitudinal movement of the actuator from the extended position to a retracted position by an operator.

10 Claims, 9 Drawing Sheets

MANUALLY ACTUATED PUMP

BACKGROUND OF THE INVENTION

1. Field of the Invention

This invention relates to dispensing, and more particularly to an improved manually actuated pump characterized as an accumulative pump having a high compression ratio for providing superior performance for pump a product from a container for discharge from a terminal orifice.

2. Background of the Invention

Hand operated pumps are being used to dispense a wide variety of products such as household, institutional and personal care products and the like. Typically, a hand operated pump comprised a body defining an internal pump cylinder for receiving a reciprocating piston slidably disposed within the internal pump cylinder for defining a pump chamber. The pump is secured to a container for receiving liquid from the container through an induction tube. A pump stem had a first and a second stem end with a stem passage extending therebetween. The first stem end of the stem cooperated with the piston slidably disposed within the internal pump cylinder whereas the second stem end supports an actuator having a terminal orifice.

A first one-way valve enabled the flow of the liquid from the container into the internal pump cylinder whereas a second one-way valve enables the flow of the liquid from the internal pump cylinder to the terminal orifice. A spring biased the piston and the pump stem into an extended position for enabling an operator to reciprocate the piston between the extended position to a retracted position for pumping the liquid from the internal pump cylinder for discharge from the terminal orifice.

In many cases, it was desirable to allow the air pressure within the pump chamber to accumulate prior to the opening of the second one-way valve. The accumulation of the air pressure within the pump chamber insured a sufficient pressure within the pump chamber prior to the opening of the second one-way valve to properly discharge the liquid from the terminal orifice. The accumulation of the air pressure within the pump chamber produced a more uniform spray pattern throughout the movement of the pump stem from the extended position to the retracted position. Furthermore, the accumulation of the air pressure within the pump chamber reduced any dribbling of the liquid product from the terminal orifice when the pump stem is proximate to the extended position or proximate to the retracted position. Mechanically actuated pumps that were characterized by accumulating air pressure within the pump chamber prior to opening of the second one-way valve were commonly referred to as accumulative pumps.

In order to configure a manually actuated pump to function as an accumulative pump, the second one-way valve were be designed to open only upon the establishment of a predetermined minimum pressure. This predetermined minimum pressure insured the second one-way valve would open only when there was adequate pressure within the pump chamber to properly discharge the liquid from the terminal orifice.

When a mechanical operated pump was first used, the mechanical operated pump had to be capable of removing the air within the pump chamber and to draw the liquid from the container into the pump chamber. This process was commonly referred to as priming the pump. Unfortunately, the mechanically operated pumps of the prior an could not generate a sufficient pressure within the pump chamber to equal or exceed the predetermined minimum pressure necessary to open the second one-way valve. Accordingly, various methods and were incorporated within the pumps of the prior art to insure the priming of the mechanically operated pumps of the prior art.

In many cases, the manually actuated pumps of the prior art primed the pump through the diptube through a lost motion between the piston and the pump stem. Other manually actuated pumps of the prior art primed the pump through a vent between the pump stem and a closure by breaking the seal of the pump chamber.

Another associated difficulty of the prior art accumulative pumps is the low pump chamber pressure generated by the prior art accumulative pumps. The low pump chamber pressure generated by the prior art accumulative pumps adversely affected the spray performance of the pump when dispensing certain liquid products.

A further associated difficulty of the prior art accumulative pumps is the low compression ratio of the prior art accumulative pumps. The low compression ratio of some prior art accumulative pumps limited the ability of the pump to dispense high viscosity liquids from the container. Accordingly, these low compression pumps of the prior art had a limited range of liquids that could be satisfactorily dispensed from the pump.

Although the aforementioned prior art pumps have contributed to the dispensing art, there is a need for a high performance high compression ratio pump capable of high performance dispensing of a wide variety of liquids having various viscosities.

Therefore, it is an object of the present invention to provide an improved manually actuated pump having the properties of an accumulative pump with a high compression ratio for enabling the pump to be primed through a terminal orifice.

Another object of this invention is to provide an improved manually actuated pump having the properties of an accumulative pump that is capable of generating a high pump chamber pressure for providing superior spray performance.

Another object of this invention is to provide an improved manually actuated pump having the properties of an accumulative pump that is capable of spraying a variety of liquid products.

Another object of this invention is to provide an improved manually actuated pump having the properties of an accumulative pump that is capable of spraying a wide variety of liquid products having various viscosities.

Another object of this invention is to provide an improved manually actuated pump having the properties of an accumulative pump that provide a high flow rate to the liquid product that is discharged from the pumps.

Another object of this invention is to provide an improved manually actuated pump having the properties of an accumulative pump that incorporates a first and a second one-way valve wherein the second one-way valve provides a metering orifice for liquid product discharged from the terminal orifice.

Another object of this invention is to provide an improved manually actuated pump having the properties of an accumulative pump that incorporates a first and a second one-way valve wherein the second one-way valve includes a valve projection for engaging with a surface when the piston is moved in proximity to a retracted position to open the second one-way valve for releasing compressed air within a pump chamber for priming the manually actuated pump.

Another object of this invention is to provide an improved manually actuated pump having the properties of an accumulative pump that minimizes the construction material required to fabricate the pump for making the pump economically advantageous over the pumps of the prior art.

Another object of this invention is to provide an improved manually actuated pump having the properties of an accumulative pump that can be constructed of molded plastic parts with a minimum of mold cavities.

Another object of this invention is to provide an improved manually actuated pump having the properties of an accumulative pump that may be assembled on automatic assembly machines with a minimum of assembly operations.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved manually actuated pump for dispensing a volume of liquid from a container, comprising a body having a first and a second body end with an internal body surface defining an internal body region. The body is secured to the container with a duct extending from the first end of the body into the internal body region of the body. The duct has a substantially cylindrical external duct surface and an internal duct surface defining a duct conduit communicating with the internal body region of the body. A piston having a first and a second piston portion with the first piston portion is disposed within the internal body region of the body and with at least a portion of the second piston portion being disposed external to the internal body region of the body. A spring coacts between the body and the piston for biasing the piston into an extended position. The first portion of the piston is substantially cylindrical for slidably sealing the with cylindrical body surface of the body to define a pump chamber. An induction tube is receivable within the duct conduit for providing fluid communication between the liquid within the container and the pump chamber. A first one-way valve means is disposed within the duct conduit for enabling the flow of the liquid only from the container into the pump chamber. The second piston portion defines a piston stem having a first stem end disposed within the internal body region and a second stem end disposed external the internal body region with a stem passage extending therebetween. A second one-way valve means is disposed in proximity to the stem passage for enabling the flow of the liquid only from the pump chamber into the stem passage of the piston stem. An actuator having a terminal orifice communicating with the stem passage of the piston stem discharges a volume of the liquid from the container through the terminal orifice upon a longitudinal movement of the actuator from the extended position to a retracted position by an operator.

In a more specific embodiment of the invention, the container has a container rim defining a container opening. The securing means comprises a flange extending radially outwardly from the body with a closure having a central opening for receiving the body therein enabling the closure to be affixed to the container for securing the flange into engagement with the container rim. In one embodiment of the invention, a vent is defined between the piston stem and the closure for venting the container upon a longitudinal movement of the actuator from the extended position to a retracted position by an operator. Preferably, the piston has a vent sealing surface engageable with the closure when the piston is in the extended position for sealing the vent. A drain aperture is located within body in proximity to the first body end for draining accumulated liquid external the pump chamber.

In another example of the invention, the internal body surface defines a body shoulder within the internal body region with the piston defining a piston shoulder disposed within the internal body region of the body. The spring coacts between the body shoulder and the piston shoulder for biasing the piston into an extended position.

Preferably, the first one-way valve comprises the duct defining a terminal duct end with the duct conduit having an enlarged region proximate to the terminal duct end defining a first valve seat. A first valve element is movable within the enlarged region for engagement with the first valve seat for enabling the flow of the liquid only from the container into the pump chamber. Preferably, the first valve element comprises a ball valve element movable for engagement with the first valve seat for enabling the flow of the liquid only from the container into the pump chamber.

The second one-way valve comprises the first stem end of the piston stem defining a second valve seat and a second valve element being movable within the stem passage and biased into engagement with the second valve seat for enabling the flow of the liquid only from the pump chamber into the stem passage of the piston stem. In one embodiment of the invention, the second valve element includes a valve projection extending from the first end of the piston stem for enabling the valve projection to engage a surface when the piston is moved in proximity to the retracted position to open the second one-way valve for releasing compressed air within the pump chamber for priming the manually actuated pump.

In a preferred embodiment of the invention, the first one-way valve comprises a first movable valve element and the second one-way valve comprises the first stem end of the piston stem defining a second valve seat with the second valve element being movable within the stem passage and biased into engagement with the second valve seat. The second valve element includes a valve projection extending from the first end of the piston stem for enabling the valve projection to engage the first movable valve element when the piston is moved in proximity to the retracted position to close the first one-way valve and to simultaneously open the second one-way valve for releasing compressed air within the pump chamber for priming the manually actuated pump.

In another specific example of the invention, the first one-way valve comprises the duct defining a terminal duct end having a partially substantially hemispherical terminal end. The piston has a portion within the substantially cylindrical first portion of the piston having a partially substantially hemispherical recess. The substantially hemispherical terminal end of the duct is receivable within the substantially hemispherical recess for increasing a compression ratio of the pump for enabling the pump to prime the pump through the terminal orifice.

In another embodiment of the invention, the stem passage has a substantially cylindrical portion with the second one-way valve comprising the first stem end of the piston stem defining a second valve seat and a second valve element being movable within the stem passage and biased into engagement with the second valve seat. The second valve element has a cylindrical portion for sliding within the stem passage with the cylindrical portion of the stem passage cooperating with the cylindrical portion of the second valve for controlling the flow rate of the liquid discharged from the terminal orifice. Preferably, the cylindrical portion of the stem passage and the cylindrical portion of the second valve define an annular metering passage therebetween for controlling the flow rate of the liquid discharged from the terminal orifice.

The second valve element defines a first and a second end with the second end having a respite for receiving a helical spring therein for biasing the second valve element into engagement with the second valve seat. The helical spring has a helical pitch for substantially totally collapsing when the second valve element is displaced from the second valve seat for occupying a substantial volume of the respite.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
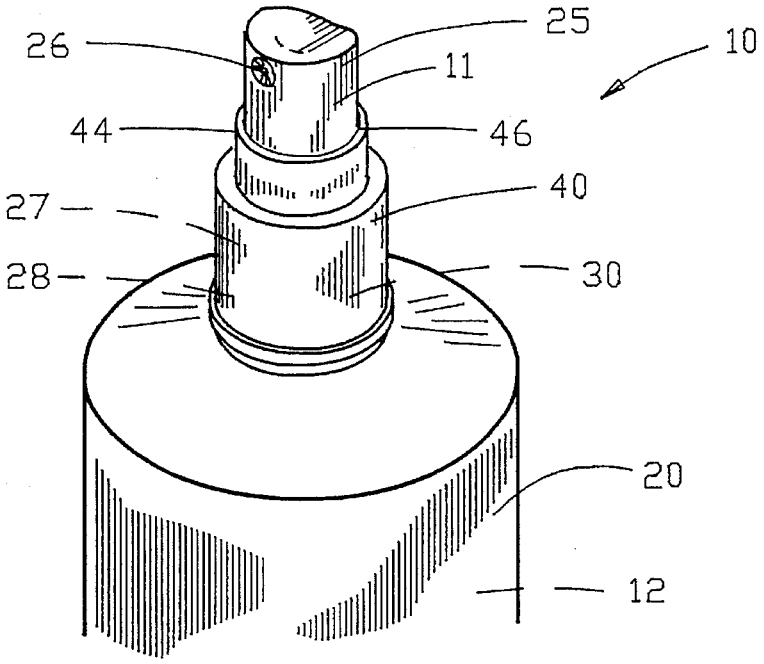
FIG. 1 is a partial isometric view of the improved manually actuated pump of the present invention secured to a container with an actuator located in an extended position.
Figure 2:
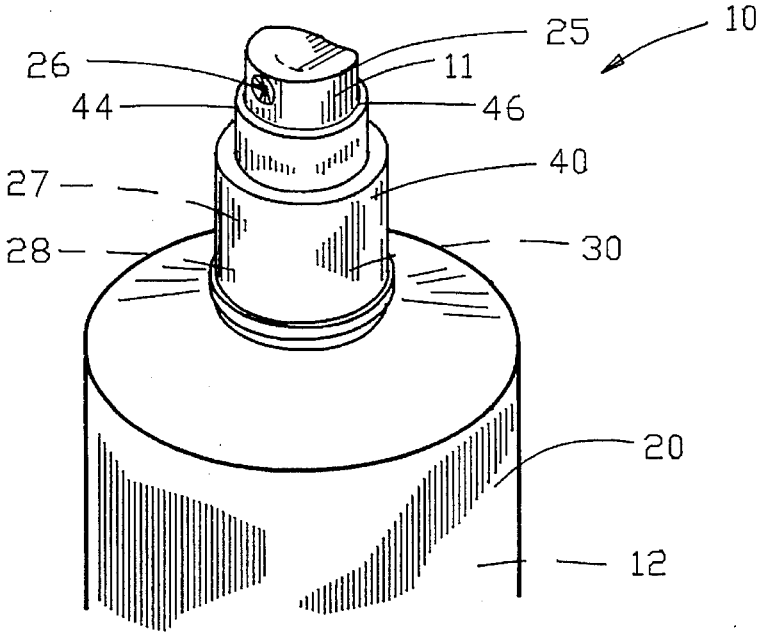
FIG. 2 is a partial isometric view of the improved manually actuated pump of FIG. 1 with the actuator located in a first retracted position thereby dispensing a first volume of a liquid from the container.

FIGS. 1 and 2 are partial isometric views of the improved manually actuated pump 10 of the present invention for pumping a liquid 12 from a container 20 upon depression of an actuator 25. As will be described in greater detail hereinafter, reciprocation of the actuator 25 between the extended position shown in FIG. 1 and the retracted position shown in FIG. 2 results in the pumping of the liquid 12 in the container 20 through a terminal orifice 26. The container 20 is shown as a conventional container 20 comprising a container rim 27 defining a container opening 28 therein.

Figure 3:
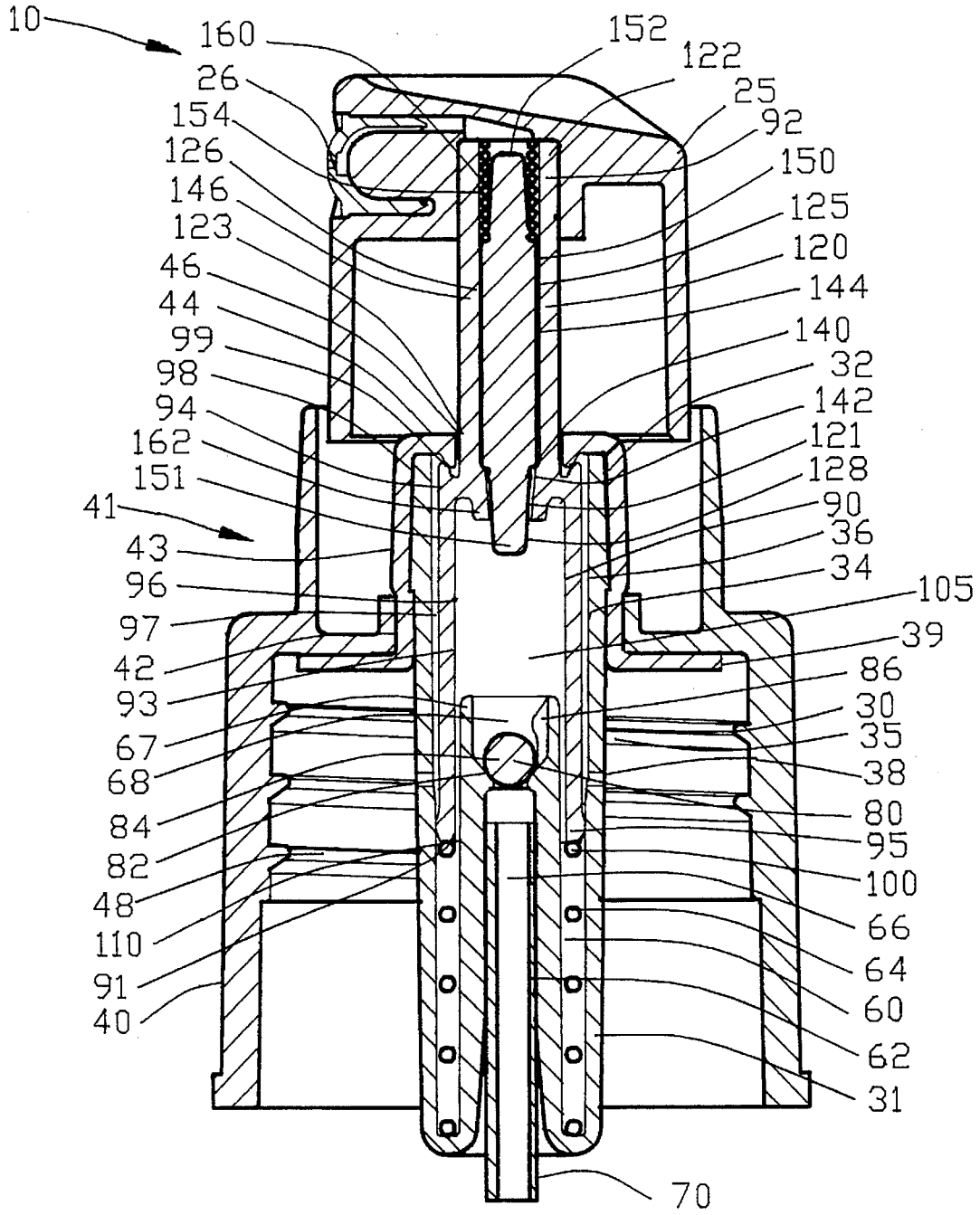
FIG. 3 is a side sectional view of a first embodiment of the improved manually actuated pump with the actuator located in an extended position.
Figure 4:
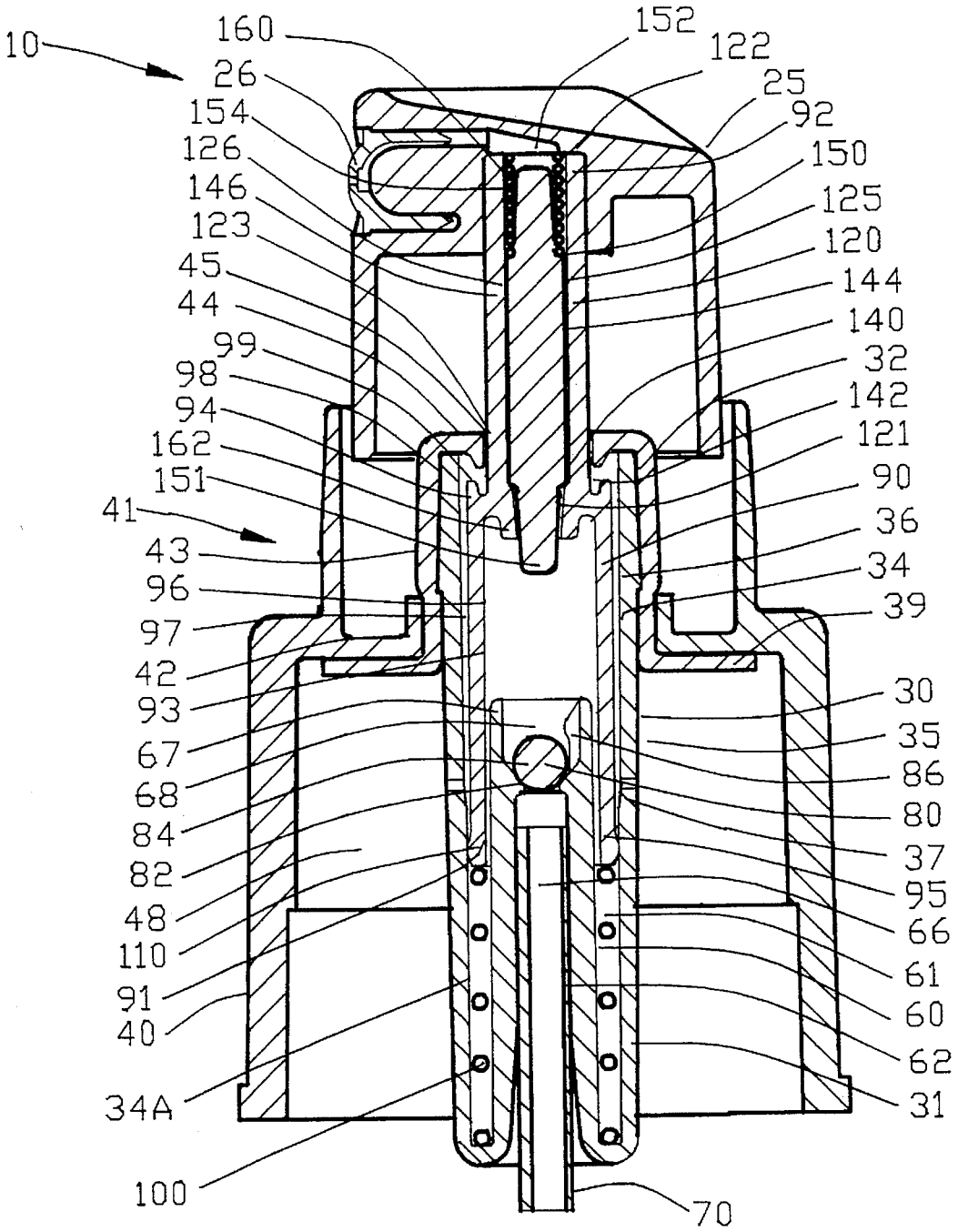
FIG. 4 is a side sectional view of the manually actuated pump of FIG. 1 with the actuator located in a slightly retracted position.
Figure 5:
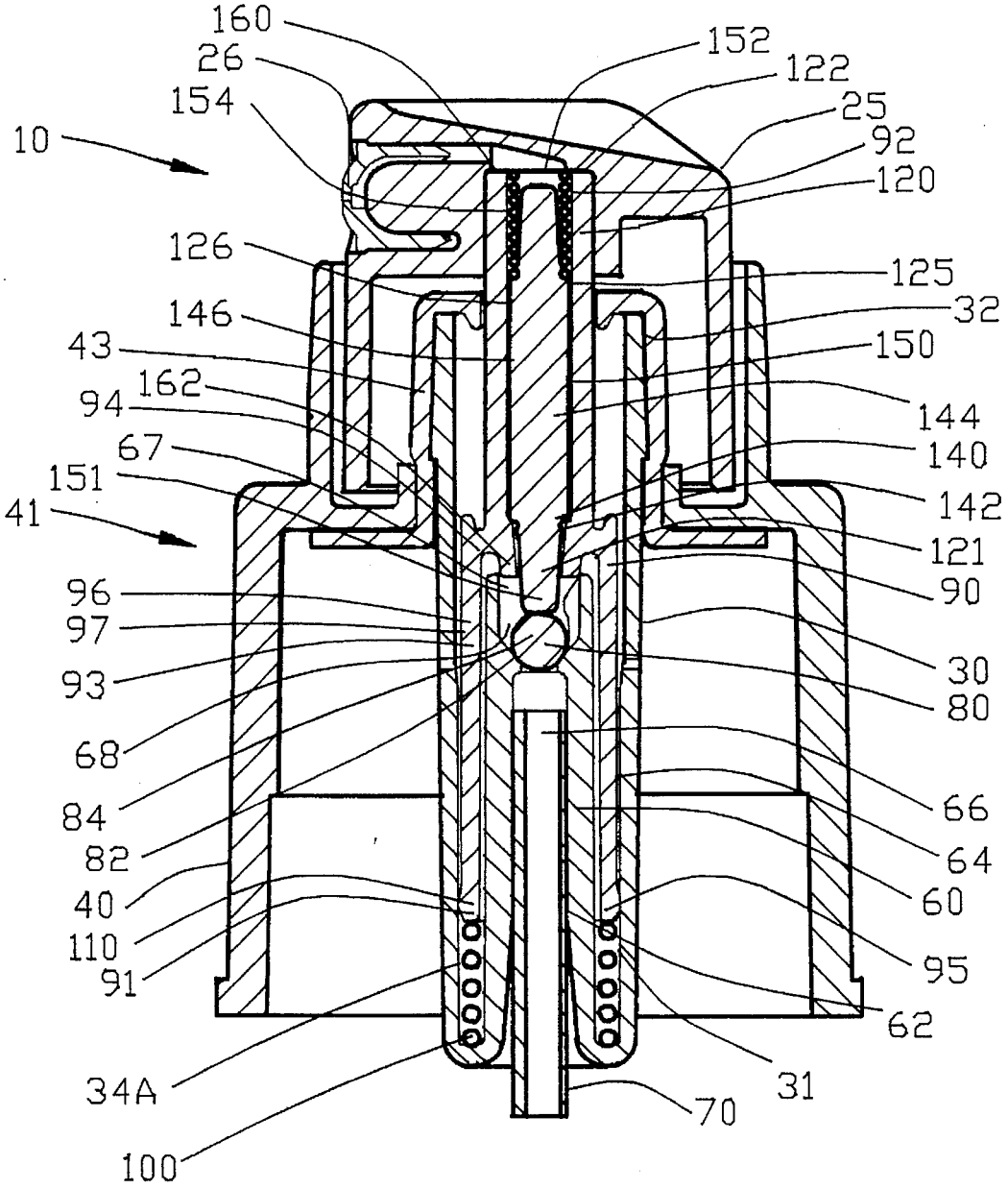
FIG. 5 is a side sectional view of the manually actuated pump of FIG. 1 with the actuator located in a further retracted position.
Figure 6:
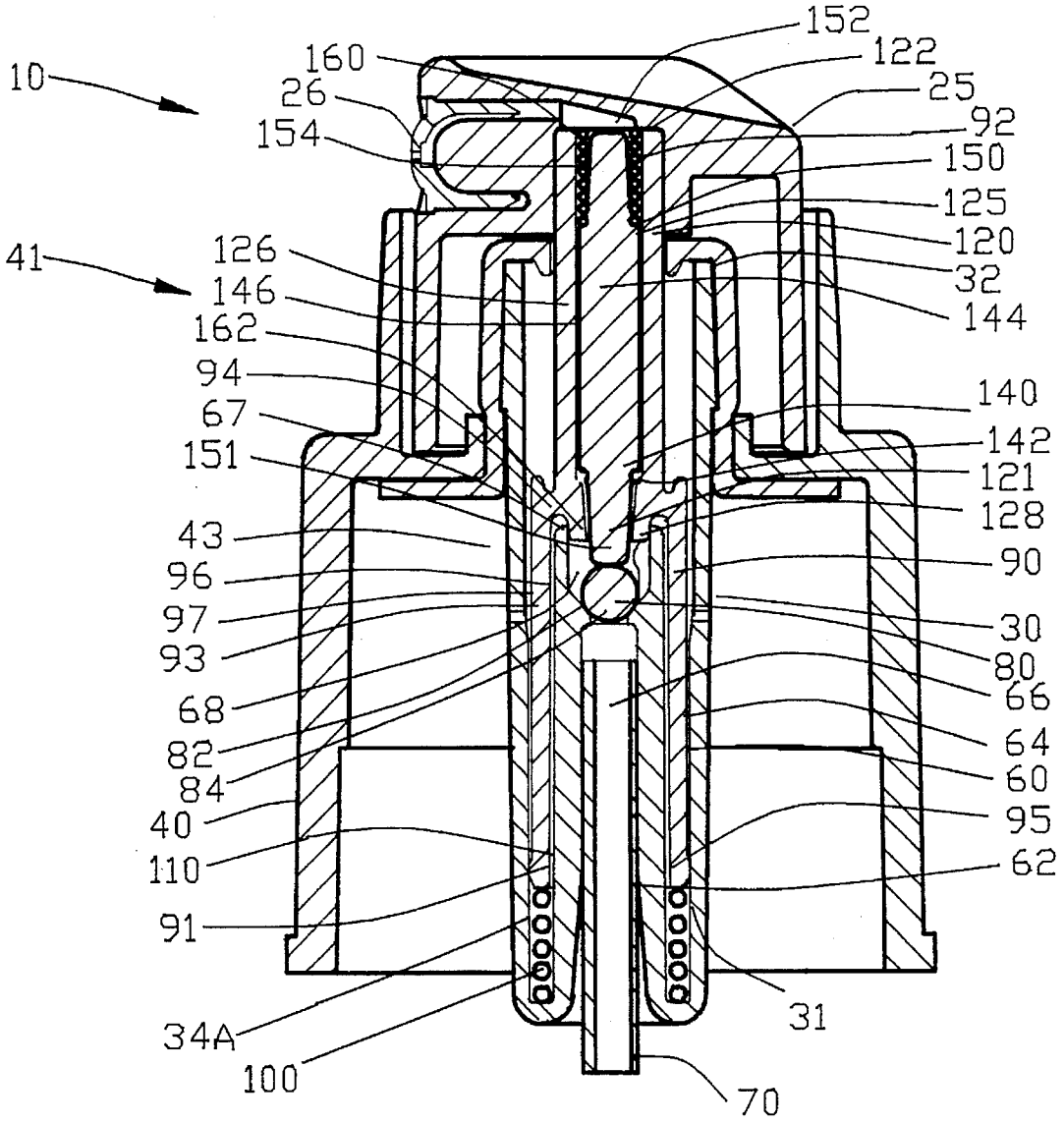
FIG. 6 is a side sectional view of the manually actuated pump of FIG. 1 with the actuator located in a fully retracted position.

FIGS. 3–6 are side sectional views of a first embodiment of the improved manually actuated pump 10 with the actuator 25 shown in various positions. FIG. 3 illustrates the actuator 25 in an extended position, FIG. 4 illustrates the actuator 25 in a slightly retracted position, FIG. 5 illustrates the actuator 25 in a further retracted position and FIG. 6 illustrates the actuator 25 in a fully retracted position.

The manually actuated pump 10 comprises a body 30 having a first and a second body end 31 and 32 with an internal body surface 34 and an external body surface 35. The internal body surface 34 defines an internal body region 36. A portion of the internal body surface 34 defines a substantially cylindrical body surface 34A. The body 30 includes a body vent aperture 38 for enabling air to pass from the internal body region 36 of the body 30 into the container 20 as will be described in greater detail hereinafter. A flange 39 extends radially outwardly relative to the body 30 for securing the body 30 to the container 20 as set forth hereinafter.

The pump body 30 is secured to a closure 40 by a securing means shown generally as 41. The closure 40 has a central opening 42 for receiving the second end 32 of the body 30 therein. The securing means 41 comprises the flange 39 extending radially outwardly relative to the body 30 for securing the body 30 to the container 20. In this embodiment, the flange 39 is integrally formed with a turret 43 and extends radially outwardly relative to the external body surface 35. The securing means 41 is shown as a Combined Turret and Closure Seal set forth in application Ser. No. 08/275,367 filed Jul. 15, 1994 the content of which is incorporated by reference into the present specification. It should be appreciated that the present invention is suitable for use with a conventional means for securing the body to the container as should be well known to those skilled in the art.

A crown 44 integrally extends from the turret of 43 and defines an aperture 46. The second end 32 of the pump body 30 engages with the crown 44 when the body 30 is secured to the closure 40. The closure 40 is shown having closure threads 48 for securing with container threads (not shown) extending about the container rim 27 of the container 20 in a conventional fashion. When the closure 40 is secured to the container 20, the flange 39 engages with the container rim 27 of the container 20 to seal the pump body 30 to the container 20. Although the closure 40 has been shown attached to the container 20 through closure threads 48, it should be understood that various means may be utilized for securing the closure 40 to the container 20.

A duct 60 extends from the first end 31 of the body 30 into the internal body region 36 of the body 30. The duct 60 has an internal duct surface 62 and a substantially cylindrical external duct surface 64. The internal duct surface 62 of the duct 60 defines a duct conduit 66 communicating with the internal body region 36 of the body 30. The duct 60 defines a terminal duct end 67 with the duct conduit 66 having an enlarged region 68 proximate to the terminal duct end 67. Preferably, the duct 60 is integrally formed with the body 30.

An induction tube 70 is frictionally secured into a portion of the duct conduit 66. The induction tube 70 provides fluid communication between the liquid 12 within the container 20 and the internal body region 36 of the body 30. The induction tube 70 is shown as a Dip Tube For Hand Operated Dispensing Device as set forth in application Ser. No. 08/233,039 filed Apr. 25, 1994 and application Ser. No. 08/233,040 filed Apr. 25, 1994 the content of which are incorporated by reference into the present specification. It should be appreciated that the present invention is suitable for use with a conventional induction tube.

A first one-way valve 80 is located proximate the first body end 31 of the body 30 for enabling the flow of the liquid 12 only from the container 20 into the internal body region 36 of the body 30. In this embodiment, the first one-way valve means 80 comprises the terminal duct end 67 defining a first valve seat 82. The first one-way valve means 80 includes a first valve element 84 being movable within the enlarged region 68 for engagement with the first valve seat 82 for enabling the flow of the liquid 12 only from the container 20 into the internal body region 36 of the body 30. In this embodiment of the invention, the first valve element 84 comprises a ball valve element disposed within the enlarged region 68 of the duct conduit 66 for movement into and out of engagement with the first valve seat 82. A plurality of retainers 86 maintain the first valve element 84 within the enlarged region 68 in the event of the inversion of the improved manually actuated pump 10.

The improved manually actuated pump 10 includes a piston 90 having a first and a second piston portion 91 and 92. The first piston portion 91 of the piston 90 is disposed within the internal body region 36 of the body 30 and at least a portion of the second piston portion 92 is disposed external to the internal body region 36 of the body 30. The first piston portion 91 of the piston 90 defines a cylindrical piston skirt 93 having a piston skirt base 94 and a piston skirt end 95. The cylindrical piston skirt 93 includes an inner piston skirt surface 96 and an outer piston skirt surface 97. The piston 90 includes a vent sealing surface 99 the function of which will be described in greater detail hereinafter.

A helical metallic spring 100 coacts between the body 30 and the piston 90 for biasing the piston 90 into the extended position as shown in FIG. 3. In this embodiment of the invention, the metallic spring 100 coacts between the first end 31 of the body 30 and the piston skirt end 95 for biasing .the piston 90 into the extended position. Preferably, the cylindrical piston skirt 93 is established in close proximity to the internal body surface 34.

The cylindrical piston skirt 93 of the first portion 91 of the piston 90 forms a sliding seal with the substantially cylindrical body surface 34A for defining a pump chamber 105. In this embodiment of the invention, the sliding seal comprises an outwardly extending sliding ring seal 110 between the piston skirt end 95 and the substantially cylindrical body surface 34A. Preferably, the piston 90 is constructed of a resilient material for resiliently biasing the piston skirt end 95 into engagement with the cylindrical body surface 34A.

The second piston portion 92 of the piston 90 defines a piston stem 120 having a first stem end 121 disposed within the internal body region 36 of the body 30 and a second stem end 122 disposed external the internal body region 36. The piston stem 120 extends through the aperture 46 within the turret 43 of the closure 40. A vent 123 is defined between the piston stem 120 and the crown 44 of the closure 40 for venting the container 20 through the body vent aperture 38 upon a longitudinal movement of the actuator 25 from the extended position shown in FIG. 3 into the slightly retracted position as shown in FIG. 4. The vent sealing surface 99 of the piston 90 is engageable with the crown 44 of the turret 43 when the piston 90 is in the extended position as shown in FIG. 3 for sealing the vent 123.

A stem passage 125 extends between the first stem end 121 and the second stem end 122 the second piston portion 92 with the stem passage 125 including a substantially cylindrical portion 126. The actuator 25 is secured to the second stem end 122 of the piston stem 120 and encloses the stem passage 125 to provide fluid communication from the stem passage 124 to the terminal orifice 26 of the actuator 25. Preferably, the actuator 25 is frictionally secured to the second stem end 122 of the piston stem 120. In the alternative, the actuator 25 may be secured to the second stem end 122 of the piston stem 120 by a cooperating annular recess and annular projection (not shown) as should be well known to those skilled in the art. An annular stem projection 128 extends into the internal body region 36 for mating with the enlarged region 68 of the duct 60 when the actuator is located in the retracted position as shown in FIG. 6. The terminal orifice 26 is shown as a Terminal Orifice System as set forth in application Ser. No. 08/294,054 filed Aug. 24, 1994 the content of which is incorporated by reference into the present specification. It should be appreciated that the present invention is suitable for use with a conventional terminal orifice.

A second one-way valve 140 is disposed in proximity to the stem passage 125 for enabling the flow of the liquid 12 only from the pump chamber 105 into the stem passage 125 of the piston stem 120. The second one-way valve 140 comprises the first stem end 121 of the piston stem 120 defining a second valve seat 142. A second valve element 144 has a cylindrical portion 146 for sliding within the substantially cylindrical portion 126 of the stem passage 125. The cylindrical portion 146 of the second valve element 144 within the cylindrical portion 126 of the stem passage 125 defines an annular metering passage 150 therebetween. The annular metering passage 150 controls the flow rate of the liquid 12 discharged from the terminal orifice 26 as will be described in greater detail hereinafter.

The second valve element 144 is biased into engagement with the second valve seat 142 for enabling the flow of the liquid 12 only from the pump chamber 105 into the stem passage 125 of the piston stem 120. In this embodiment of the invention, the second valve element defines a first and a second end 151 and 152 with the second end 152 having a respite 154 for receiving a helical metallic spring 160.

The helical spring 160 is disposed in the respite 154 and coacts between the actuator 25 and the second valve element 144 for biasing the second valve element 144 into engagement with the second valve seat 142 as shown in FIG. 3. Preferably, the helical spring 160 has a helical pitch for substantially totally collapsing when the second valve element 144 is displaced from the second valve seat 142 as shown in FIG. 6 for occupying substantially the volume of the respite 154. The substantially totally collapsing of the helical spring 160 occupying the volume of the respite 154 reduces unnecessary volume in the flow path of the liquid 12 from the pumping chamber 105 to the terminal orifice 26. In this embodiment of the invention, the helical spring 160 is maintained within the respite 154 by the actuator 25 being secured to the second stem end 122 of the piston stem 120 and enclosing the stem passage 125.

In this embodiment of the invention, the second valve element 144 including a valve projection 162 extending from the first stem end 121 of the piston stem 120 when the second valve element 144 is biased into engagement with the second valve seat 142 as shown in FIG. 3. The valve projection 162 engages a surface shown as the first valve element 84 within the enlarged region 68 when the piston 90 is moved in proximity to the retracted position as shown in FIG. 5. The valve projection 162 moves the second valve element 144 against the biased of the helical spring 160 out of engagement with the second valve seat 142 when the actuator 25 is moved into the fully retracted position as shown in FIG. 6. The valve projection 162 mechanically opens the second one-way valve 140 when the actuator 25 is moved into the fully retracted position as shown in FIG. 6. The mechanical opening of the second one-way valve 140 when the actuator 25 is moved into the fully retracted position as shown in FIG. 6 releases compressed air within the pump chamber 105 through the terminal orifice 26 for priming the manually actuated pump 10. In addition to the valve projection 162 mechanically opening the second one-way valve 140 when the actuator 25 is moved into the fully retracted position as shown in FIG. 6, the valve projection 162 mechanically closed the first one-way valve 80 to insure the release of compressed air within the pump chamber 105 through the terminal orifice 26 for priming the manually actuated pump 10 as will be described hereinafter.

In this embodiment of the first and second ends 151 and 152 of the second valve element 144 are symmetric. The valve projection 162 is identical to the respite 154 for enabling projection 162 to be interchanged with the respite 154. The symmetry of the second valve element 144 eliminates the need to orient the second valve element 144 during assembly of the manually actuated pump 10.

The manually actuated pump 10 of FIGS. 3–6 operates in the following manner. Initially, the metallic spring 100 biases the vent sealing surface 99 of the piston 90 into engagement with the crown 44 of the turret 43 for sealing the vent 123 when the piston 90 is in the extended position as shown in FIG. 3. Upon depression of the actuator 25 by an operator, the vent sealing surface 99 of the piston 90 is moved from the crown 44 of the turret 43 to open the vent 123 for venting the container 20 through the body vent aperture 38 as shown in FIG. 4. As the operator continues to depress the actuator 25, the piston 90 compresses the air within the pump chamber 105 as shown in FIG. 5.

The manually actuated pump 10 of the present invention is configured to have a high compression ratio. The compression ratio is determined by the ratio of the volume of the pump chamber 105 when the actuator located in the extended position as shown in FIG. 3 divided by the volume of the pump chamber 105 when the actuator is located in the fully retracted position as shown in FIG. 6. The high compression ratio of the manually actuated pump 10 of the present invention is in part produced by the reduction of the volume of the pump chamber 105 when the actuator is located in the retracted position as shown in FIG. 6. The annular stem projection 128 of the piston 90 is configured to mate with the enlarged region 68 of the duct 60 within the pump chamber 105 for reducing the volume of the pump chamber 105 when the actuator is located in the retracted position as shown in FIG. 6.

The high compression ratio of the manually actuated pump 10 of the present invention appears is sufficient to open the second one-way valve 140 to release the compressed air in the pump chamber 105 through the terminal orifice 26. When the pressure within the pump chamber 105 accumulates to a sufficient level, the second one-way valve 140 opens to release compressed air within the pump chamber 105 through the terminal orifice 26 for priming the manually actuated pump 10.

In the unlikely event the high compression ratio of the manually actuated pump 10 of the present invention is insufficient to open the second one-way valve 140, continued depression of the actuator by the operator continues to compress the air within the pump chamber 105 until the valve projection 162 mechanically opens the second one-way valve 140 when the actuator 25 is moved into the fully retracted position as shown in FIG. 6. The mechanical opening of the second one-way valve 140 releases the compressed air within the pump chamber 105 through the terminal orifice 26.

When the actuator 25 is released by the operator, the piston 90 is returned to the extended position shown in FIG. 3 to expand the pump chamber 105 to withdraw the liquid 12 from the container 20 into the pump chamber 105. Several depressions of the actuator 25 by an operator as set forth above may be necessary for withdrawing a sufficient quantity of the liquid 12 from the container 20 into the pump chamber 105 to pump the liquid from the terminal orifice 26.

When a sufficient quantity of the liquid 12 is within the pump chamber 105 depression of the actuator 25 by the operator compresses the pump chamber 105 to close the first one-way valve means 80. Continued depression of the actuator 25 by the operator, accumulates pressure within the pump chamber 105 until the second one-way valve 140 opens to pump the liquid 12 through the stem passage 125 to be discharged from the terminal orifice 26.

The annular metering passage 150 defined between the cylindrical portion 146 of the second valve element 144 and the cylindrical portion 126 of the stem passage 125 controls the flow rate of the liquid 12 discharged from the terminal orifice 26. Accordingly, the flow rate of the manually actuated pump 10 may be adapted to pump various types of liquids 12 for various types of spray characteristics by the selection of the second valve element 144 and the cylindrical portion 126 of the stem passage 125.

Figure 7:
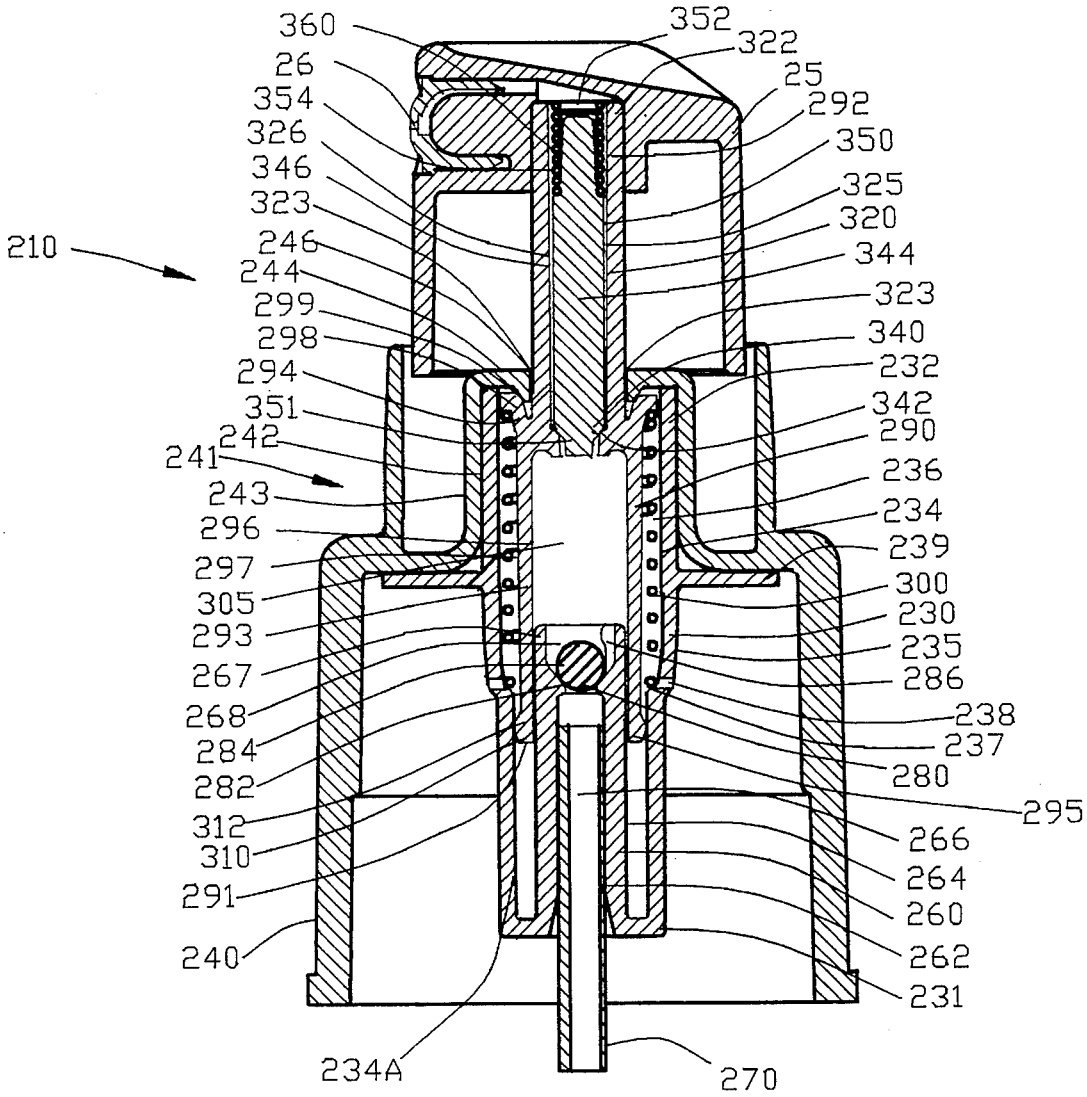
FIG. 7 is a side sectional view of a second embodiment of the improved manually actuated pump with the actuator located in the extended position.
Figure 8:
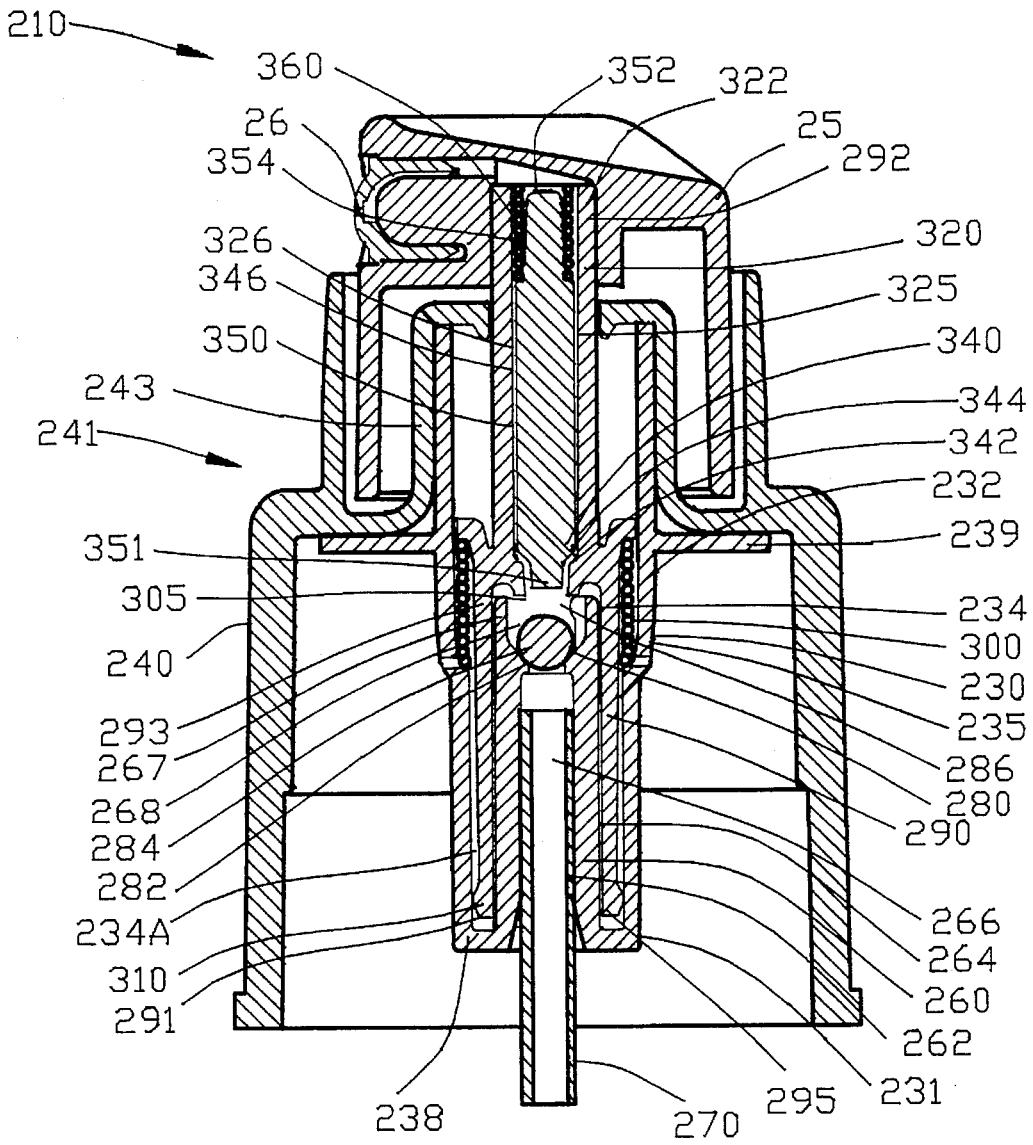
FIG. 8 is a side sectional view of the manually actuated pump of FIG. 7 with the actuator located in a fully retracted position.

FIGS. 7 and 8 are sectional views of a second embodiment of the improved manually actuated pump 210 with FIG. 7 illustrating the actuator 25 in an extended position and with FIG. 8 illustrating the actuator 25 in a retracted position.

The manually actuated pump 210 comprises a cylindrical body 230 having a first and a second body end 231 and 232 with an internal body surface 234 and an external body surface 235. The internal body surface 234 defines an internal body region 236. A portion of the internal body surface 234A defines a substantially cylindrical body surface 234A. A body shoulder 237 is defined by the internal body surface 234 to extend inwardly into the internal body region 236 of the body 230. The body 230 includes a body vent aperture 238 for enabling air to pass from the internal body region 236 of the body 230 into the container 20. A flange 239 is integrally formed with the body 230 to extend radially outwardly from the external body surface 235.

The pump body 230 is secured to a closure 240 by a securing means shown generally as 241. The closure 240 has a central opening 242 for receiving the second end 232 of the body 230 therein. The securing means 241 comprises the flange 239 integrally extending radially outwardly from the body 230 for securing the body 230 to the container 220. The securing means 41 is shown as a Combined Turret and Closure Seal set forth in application Ser. No. 08/275,367 filed Jul. 15, 1994.

A crown 244 integrally extends from the closure 240 and defines an aperture 246. The second end 232 of the pump body 230 engages with the crown 244 when the body 230 is secured to the closure 240 by means (not shown). When the closure 240 is secured to the container 20, the flange 239 engages with the container rim 27 of the container 20 to seal the pump body 230 to the container 20.

A duct 260 extends from the first end 231 of the body 230 into the internal body region 236 of the body 230. The duct 260 has an internal duct surface 262 and a substantially cylindrical external duct surface 264. The internal duct surface 262 of the duct 260 defines a duct conduit 266 communicating with the internal body region 236 of the body 230. The duct 260 defines a terminal duct end 267 with the duct conduit 266 having an enlarged region 268 proximate to the terminal duct end 267. Preferably, the duct 260 is integrally formed with the body 230.

An induction tube 270 is frictionally secured into a portion of the duct conduit 266. The induction tube 270 provides fluid communication between the liquid 12 within the container 20 and the internal body region 236 of the body 230. The induction tube 270 is shown as a Dip Tube For Hand Operated Dispensing Device as set forth in application Ser. No. 08/233,039 filed Apr. 25, 1994 and application Ser. No. 08/233,040 filed Apr. 25, 1994.

A first one-way valve 280 is located proximate the first body end 231 of the body 230 for enabling the flow of the liquid 12 only from the container 20 into the internal body region 236 of the body 230. In this embodiment, the first one-way valve means 280 comprises the terminal duct end 267 defining a first valve seat 282. The first one-way valve means 280 includes a first valve element 284 being movable within the enlarged region 268 for engagement with the first valve seat 282 for enabling the flow of the liquid 12 only from the container 20 into the internal body region 236 of the body 230. In this embodiment of the invention, the first valve element 284 comprises a ball valve element disposed within the enlarged region 268 of the duct conduit 266 for movement into and out of engagement with the first valve seat 282. A plurality of retainers 286 maintain the first valve element 284 within the enlarged region 268 in the event of the inversion of the improved manually actuated pump 210 of the present invention.

The improved manually actuated pump 210 includes a piston 290 having a first and a second piston portion 291 and 292. The first piston portion 291 of the piston 290 is disposed within the internal body region 236 of the body 230 and at least a portion of the second piston portion 292 is disposed external to the internal body region 236 of the body 230.

The first piston portion 291 of the piston 290 defines a cylindrical piston skirt 293 having a piston skirt base 294 and a piston skirt end 295. The cylindrical piston skirt 293 includes an inner piston skirt surface 296 and an outer piston skirt surface 297. A piston shoulder 298 is located proximate to the piston skirt base 294 and extends outwardly from the piston 290 into the internal body region 236 of the body 230. The piston 290 includes a vent sealing surface 299.

A helical metallic spring 300 coacts between the body 230 and the piston 290 for biasing the piston 290 into the extended position as shown in FIG. 7. In this embodiment of the invention, the metallic spring 300 coacts between the body shoulder 237 and the piston shoulder 298 for biasing the piston 290 into the extended position.

The cylindrical piston skirt 293 of the first portion 291 of the piston 290 forms a sliding seal with the substantially cylindrical body surface 234A of the body 230 for defining a pump chamber 305. In this embodiment of the invention, the sliding seal comprises a sliding ring seal 31.0 between the piston skirt end 295 and the substantially cylindrical body surface 234A. Preferably, the piston 290 is constructed of a resilient material for resiliently biasing the piston skirt end 295 into engagement with the cylindrical body surface 234A. The sliding ring 310 may comprise an outwardly extending annular sealing ring 312 for resiliently engaging with the cylindrical body surface 234A. The outwardly extending annular sealing ring 3 12 provides a sliding seal between the piston 290 and the body 230 for forming the pump chamber 305.

The second piston portion 292 of the piston 290 defines a piston stem 320 having a first stem end 321 disposed within the internal body region 236 of the body 230 and a second stem end 322 disposed external the internal body region 236. The piston stem 320 extends through the aperture 246 within the closure 240. A vent 323 is defined between the piston stem 320 and the crown 244 of the closure 240 for venting the container 20 through the body aperture 238 upon a longitudinal movement of the actuator 25 from the extended position shown in FIG. 7. The vent sealing surface 299 of the piston 290 is engageable with the crown 244 when the piston 290 is in the extended position.

A stem passage 325 extends between the first stem end 321 and the second stem end 322 the second piston portion 292 with the stem passage 325 including a substantially cylindrical portion 326. The actuator 25 is secured to the second stem end 322 of the piston stem 320 and encloses the stem passage 325 to provide fluid communication from the stem passage 324 to the terminal orifice 26 within the actuator 25. The terminal orifice 26 is shown as a Terminal Orifice System as set forth in application Ser. No. 08/294,054 filed Aug. 24, 1994.

A second one-way valve 340 is disposed in proximity to the stem passage 325 for enabling the flow of the liquid 12 only from the pump chamber 305 into the stem passage 325 of the piston stem 320. The second one-way valve 340 comprises the first stem end 321 of the piston stem 320 defining a second valve seat 342. A second valve element 344 has a cylindrical portion 346 for sliding within the substantially cylindrical portion 326 of the stem passage 325. The cylindrical portion 346 of the second valve element 344 within the cylindrical portion 326 of the stem passage 325 defines an annular metering passage 350 therebetween. The annular metering passage 350 controls the flow rate of the liquid 12 discharged from the terminal orifice 26.

The second valve element 344 is biased into engagement with the second valve seat 342 for enabling the flow of the liquid 12 only from the pump chamber 305 into the stem passage 325 of the piston stem 320. The second valve element defines a first and a second end 351 and 352 with the second end 352 having a respite 354 for receiving a helical metallic spring 360.

The helical spring 360 is disposed in the respite 354 and coacts between the actuator 25 and the second valve element 344 for biasing the second valve element 344 into engagement with the second valve seat 342 as shown in FIG. 7. Preferably, the helical spring 360 has a helical pitch for substantially totally collapsing when the second valve element 344 is displaced from the second valve seat 342 as shown in FIG. 8 for occupying a substantial volume of the respite 354. The substantially totally collapsing of the helical spring 360 a substantial portion of the volume of the respite 354 to reduce unnecessary volume in the flow path of the liquid 12 from the pumping chamber 305 to the terminal orifice 26. In this embodiment of the invention, the helical spring 360 is maintained within the respite 354 by the actuator 26 being secured to the second stem end 322 of the piston stem 320 and enclosing the stem passage 325.

The manually actuated pump 210 of FIGS. 7 and 8 operates in the following manner. Initially, the metallic spring 300 biases the vent sealing surface 299 of the piston 290 into engagement with the crown 244 of the closure 240 for sealing the vent 323 when the piston 290 is in the extended position as shown in FIG. 7. Upon depression of the actuator 25 by an operator, the vent sealing surface 299 of the piston 290 is moved from the crown 244 to open the vent 323 for venting the container 20 through the body aperture 238. As the operator continues to depress the actuator 25, the piston 290 compresses the air within the pump chamber 305.

The high compression ratio of the manually actuated pump 210 of the present invention opens the second one-way valve 340 to release the compressed air in the pump chamber 305 through the terminal orifice 26. When the pressure within the pump chamber 305 accumulates to a sufficient level, the second one-way valve 340 opens to release compressed air within the pump chamber 305 through the terminal orifice 26 for priming the manually actuated pump 210.

When the actuator 25 is released by the operator, the piston 290 is returned to the extended position shown in FIG. 7 to expand the pump chamber 305 to withdraw the liquid 12 from the container 20 into the pump chamber 305. Several depressions of the actuator 25 by an operator as set forth above may be necessary for withdrawing a sufficient quantity of the liquid 12 from the container 20 into the pump chamber 305 to pump the liquid from the terminal orifice 26.

When a sufficient quantity of the liquid 12 is within the pump chamber 305 depression of the actuator 25 by the operator, the piston 290 compresses the pump chamber 305 to close the first one-way valve means 280. A continued depression of the actuator 25 by the operator, accumulates pressure within the pump chamber 305 until the second one-way valve 340 opens to pump the liquid 12 through the stem passage 325 to be discharged from the terminal orifice 26. The annular metering passage 350 defined between the cylindrical portion 346 of the second valve element 344 and the cylindrical portion 326 of the stem passage 325 controls the flow rate of the liquid 12 discharged from the terminal orifice 26.

Figure 9:
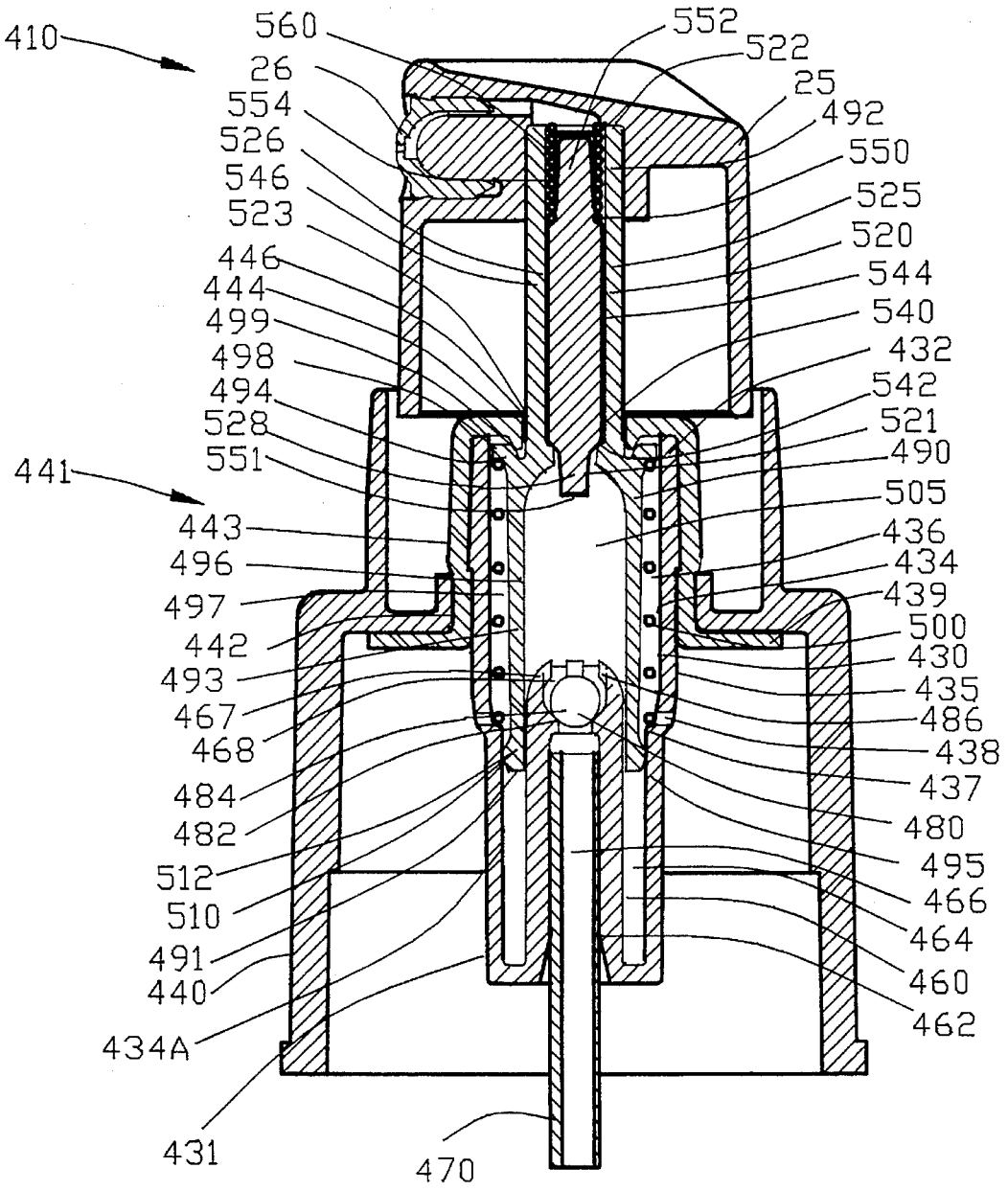
FIG. 9 is a side sectional view of a third embodiment of the improved manually actuated pump with the actuator located in the extended position.
Figure 10:
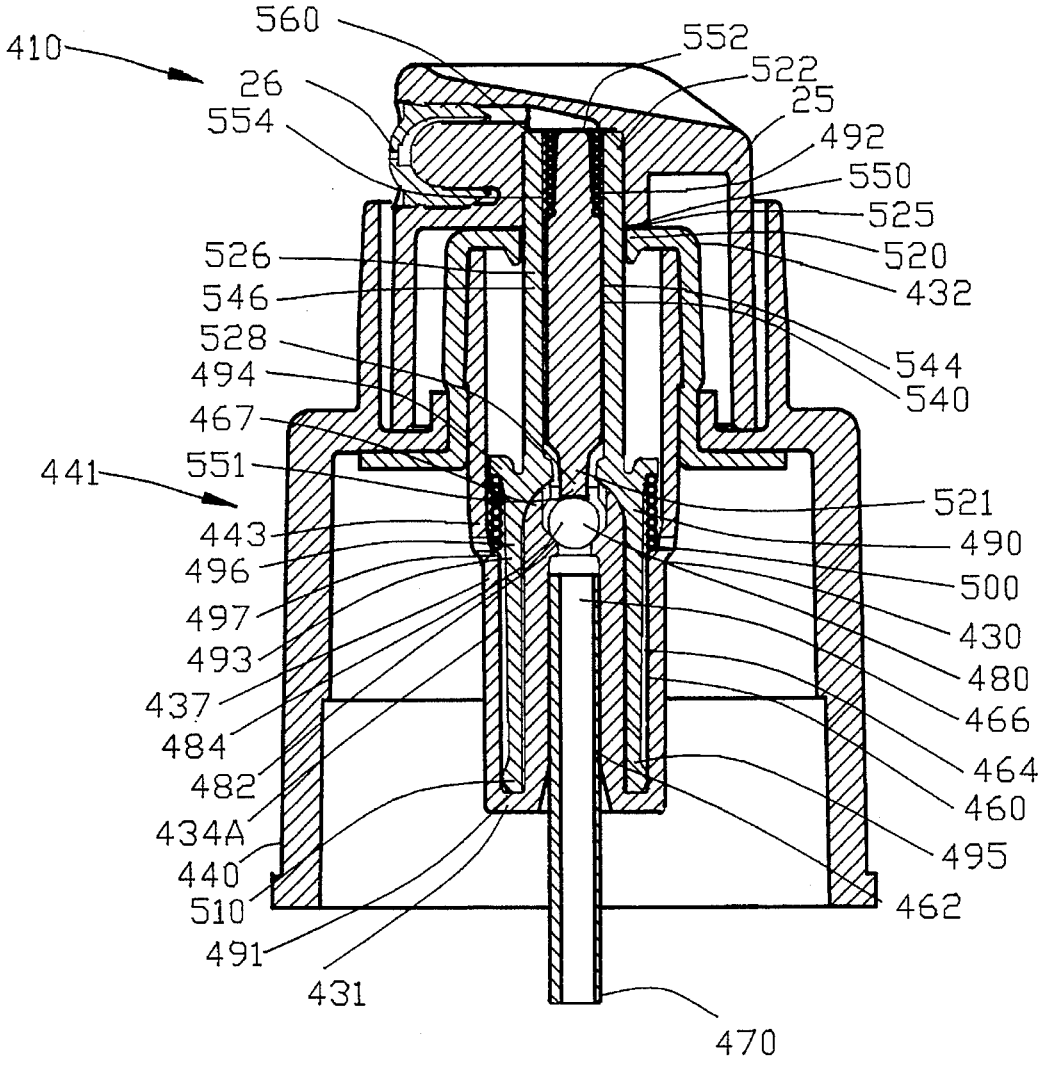
FIG. 10 is a side sectional view of the manually actuated pump of FIG. 9 with the actuator located in a fully retracted position.

FIGS. 9 and 10 are side sectional views of a third embodiment of the improved manually actuated pump 410 with FIG. 9 illustrating the actuator 25 in an extended position and with FIG. 10 illustrating the actuator 25 in a retracted position. The manually actuated pump 410 comprises a body 430 having a first and a second body end 431 and 432 with an internal body surface 434 and an external body surface 435. The internal body surface 434 defines an internal body region 436. A portion of the internal body surface 434A defines a substantially cylindrical body surface 434A. A body shoulder 437 is defined by the internal body surface 434 to extend inwardly into the internal body region 436 of the body 430. The body 430 includes a body vent aperture 438 for enabling air to pass from the internal body region 436 of the body 30 into the container 420. A flange 439 extends radially outwardly relative to the external body surface 435.

The pump body 430 is secured to a closure 440 by a securing means shown generally as 441. The closure 440 has a central opening 442 for receiving the second end 432 of the body 430 therein. The securing means 441 comprises the flange 439 extending radially outwardly relative to the body 430 for securing the body 430 to the container 420. The securing means 441 is shown as a Combined Turret and Closure Seal set forth in application Ser. No. 08/275,367 filed Jul. 15, 1994.

A crown 444 integrally extends from the turret of 443 and defines an aperture 446. The second end 432 of the pump body 430 engages with the crown 444 when the body 430 is secured to the closure 440. When the closure 440 is secured to the container 20 by means (not shown), the flange 439 engages with the container rim 27 of the container 20 to seal the pump body 430 to the container 20.

A duct 460 extends from the first end 431 of the body 430 into the internal body region 436 of the body 430. The duct 460 has an internal duct surface 462 and a substantially cylindrical external duct surface 464. The internal duct surface 462 of the duct 460 defines a duct conduit 466 communicating with the internal body region 436 of the body 430. The duct 460 defines a terminal duct end 467 with the duct conduit 466 having an enlarged region 468 proximate to the terminal duct end 467. In this embodiment of the invention, the terminal end 467 of the duct 460 has a partially substantially hemispherical terminal end 467. Preferably, the duct 460 is integrally formed with the body 430.

An induction tube 470 is frictionally secured into a portion of the duct conduit 466. The induction tube 470 provides fluid communication between the liquid 12 within the container 20 and the internal body region 436 of the body 430. The induction tube 470 is shown as a Dip Tube For Hand Operated Dispensing Device as set forth in application Ser. No. 08/233,039 filed Apr. 25, 1994 and application Ser. No. 08/233,040 filed Apr. 25, 1994.

A first one-way valve 480 is located proximate the first body end 431 of the body 430 for enabling the flow of the liquid 12 only from the container 20 into the internal body region 436 of the body 430. In this embodiment, the first one-way valve means 480 comprises the terminal duct end 467 defining a first valve seat 482. The first one-way valve means 480 includes a first valve element 484 being movable within the enlarged region 468 for engagement with the first valve seat 482 for enabling the flow of the liquid 12 only from the container 20 into the internal body region 436 of the body 430. The first valve element 484 comprises a ball valve element disposed within the enlarged region 468 of the duct conduit 466 for movement into and out of engagement with the first valve seat 482. A plurality of retainers 486 maintain the first valve element 484 within the enlarged region 468 in the event of the inversion of the improved manually actuated pump 10 of the present invention.

The improved manually actuated pump 410 includes a piston 490 having a first and a second piston portion 491 and 492. The first piston portion 491 of the piston 490 is disposed within the internal body region 436 of the body 430 and at least a portion of the second piston portion 492 is disposed external to the internal body region 436 of the body 430. The first piston portion 491 of the piston 490 defines a cylindrical piston skirt 493 having a piston skirt base 494 and a piston skirt end 495. The cylindrical piston skirt 493 includes an inner piston skirt surface 496 and an outer piston skirt surface 497. A piston shoulder 498 is located proximate to the piston skirt base 494 and extends outwardly from the piston 490 into the internal body region 436 of the body 430. The piston 490 includes a vent sealing surface 499.

A helical metallic spring 500 coacts between the body 430 and the piston 490 for biasing the piston 490 into the extended position. The metallic spring 500 coacts between the body shoulder 437 and the piston shoulder 498 for biasing the piston 490 into the extended position. Preferably, the cylindrical piston skirt 493 is established in close proximity to the internal body surface 434 between the second body end 432 and the body shoulder 437 for receiving the metallic spring 500.

The cylindrical piston skirt 493 of the first portion 491 of the piston 490 forms a sliding seal with the substantially cylindrical body surface 434A of the body 430 for defining a pump chamber 505. The sliding seal comprises a sliding ring seal 51.0 between the piston skirt end 495 and the substantially cylindrical body surface 434A. Preferably, the piston 490 is constructed of a resilient material for resiliently biasing the piston skirt end 495 into engagement with the cylindrical body surface 434A. The sliding ring 510 may comprise an outwardly extending annular sealing ring 512 for resiliently engaging with the cylindrical body surface 434A. The outwardly extending annular sealing ring 512 provides a sliding seal between the piston 490 and the body 430 for forming the pump chamber 505. The second piston portion 492 of the piston 490 defines a piston stem 520 having a first stem end 521 disposed within the internal body region 436 of the body 430 and a second stem end 522 disposed external the internal body region 436.

The piston stem 520 extends through the aperture 446 within the turret 443 of the closure 440. A vent 523 is defined between the piston stem 520 and the crown 444 of the closure 440 for venting the container 20 through the body aperture 438 upon a longitudinal movement of the actuator 25 from the extended position. The vent sealing surface 499 of the piston 490 is engageable with the crown 444 of the turret 443 when the piston 490 is in the extended position for sealing the vent 523.

A stem passage 525 extends between the first stem end 521 and the second stem end 522 the second piston portion 492 with the stem passage 525 including a substantially cylindrical portion 526. The actuator 25 is secured to the second stem end 522 of the piston stem 520 and encloses the stem passage 525 to provide fluid communication from the stem passage 524 to the terminal orifice 26 within the actuator 25. The piston 490 has a partially substantially hemispherical recess 528 for receiving the substantially hemispherical terminal end 467 of the duct 460 when the actuator 25 is located in the retracted position as shown in FIG. 10 for increasing a compression ratio of the improved manually actuated pump 410. The terminal orifice 26 is shown as a Terminal Orifice System as set forth in application Ser. No. 08/294,054 filed Aug. 24, 1994.

A second one-way valve 540 is disposed in proximity to the stem passage 525 for enabling the flow of the liquid 12 only from the pump chamber 505 into the stem passage 525 of the piston stem 520. The second one-way valve 540 comprises the first stem end 521 of the piston stem 520 defining a second valve seat 542. A second valve element 544 has a cylindrical portion 546 for sliding within the substantially cylindrical portion 526 of the stem passage 525. The cylindrical portion 546 of the second valve element 544 within the cylindrical portion 526 of the stem passage 525 defines an annular metering passage 550 therebetween. The annular metering passage 550 controls the flow rate of the liquid 12 discharged from the terminal orifice 26.

The second valve element 544 is biased into engagement with the second valve seat 542 for enabling the flow of the liquid 12 only from the pump chamber 505 into the stem passage 525 of the piston stem 520. The second valve element defines a first and a second end 551 and 552 with the second end 552 having a respite 554 for receiving a helical metallic spring 560.

The helical spring 560 is disposed in the respite 554 and coacts between the piston 490 and the second valve element 544 for biasing the second valve element 544 into engagement with the second valve seat 542. Preferably, the helical spring 560 has a helical pitch for substantially totally collapsing when the second valve element 544 is displaced from the second valve seat 542 for occupying a substantial volume of the respite 554. The substantially totally collapsing of the helical spring 560 a substantial portion of the volume of the respite 554 to reduce unnecessary volume in the flow path of the liquid 12 from the pumping chamber 505 to the terminal orifice 26. The helical spring 560 is maintained within the respite 554 by the actuator 26 being secured to the second stem end 522 of the piston stem 520 and enclosing the stem passage 525.

The second valve element 544 including a valve projection 562 extending from the first stem end 521 of the piston stem 520 when the second valve element 544 is biased into engagement with the second valve seat 542. The valve projection 562 engages a surface shown as the first valve element 484 within the enlarged region 468 when the piston 490 is moved in proximity to the retracted position. The valve projection 562 moves the second valve element 544 against the biased of the helical spring 560 out of engagement with the second valve seat 542 when the actuator 25 is moved into the retracted position. The valve projection 562 mechanically opens the second one-way valve 540 when the actuator 25 is moved into the retracted position. The mechanical opening of the second one-way valve 540 when the actuator 25 is moved into the retracted position releases compressed air within the pump chamber 505 through the terminal orifice 26 for priming the manually actuated pump 410. In addition to the valve projection 562 mechanically opening the second one-way valve 540 when the actuator 25 is moved into the retracted position, the valve projection 562 mechanically closes the first one-way valve 480 to insure the release of compressed air within the pump chamber 505 through the terminal orifice 26 for priming the manually actuated pump 410.

The manually actuated pump 410 of FIGS. 9 and 10 operates in a manner similar to the embodiment shown in FIGS. 3–6. The manually actuated pump 410 of FIGS. 9 and 10 has a high compression ratio due in part to the partially substantially hemispherical recess 528 of the piston 490 receiving the substantially hemispherical terminal end 467 of the duct 460 when the actuator 25 is located in the retracted position. In addition, the partially substantially hemispherical recess 528 provides an arcuate path from the pump chamber 505 into the stem passage 525 of the piston stem 520. The arcuate path from the pump chamber 505 into the stem passage 525 establishes a smooth arcuate flow path free from abrupt directional changes between the pump chamber 505 into the stem passage 525. The smooth arcuate flow path provides an increased flow rate of the product 12 into the stem passage 525.

The manually actuated pumps of the present invention are constructed of plastic parts. Preferably, the manually actuated pumps of the present invention are made of a rigid polymeric material such as polypropylene in combination of with a flexible polymeric material such as polyethylene. The combination of the flexible polymeric material and the rigid polymeric material enables the resilient polymeric material to form a seal with the rigid polymeric material. The manually actuated pumps of the present invention are fabricated with the body 30 being made of the more rigid polymeric material such as polypropylene and with the piston 90 being made of the more flexible polymeric material such as polyethylene material.

As should be well know to those skilled in the art, an accumulative pump accrues pressure within a pump chamber prior to the opening of the second one-way valve. The accrual of pressure within a pump chamber prior to the opening of the second one-way valve insures a sufficient pressure within the pump chamber for properly discharging a liquid from the terminal orifice. Unfortunately, the compression of air within an unprimed pump chamber of a prior art accumulative pump is insufficient to open the second one-way valve to release the compressed air in the pump chamber through the terminal orifice. Accordingly, the accumulative pump of the prior art primed the accumulative pump by means other than releasing the compressed air within the pump chamber through the terminal orifice.

In the manually actuated pump 10 of the present invention, the high compression ratio of the manually actuated pump 10 opens the second one-way valve 140 to release the compressed air in the pump chamber 105 through the terminal orifice 26. In the event the high compression ratio of the manually actuated pump 10 is insufficient to open the second one-way valve 140, the manually actuated pump 10 mechanically opens the second one-way valve 140 to release the compressed air within the pump chamber through the terminal orifice. It has been calculated that the manually actuated pump 10 of the present invention has a compression ratio of ten to one (10:1) compared to the compression ratio of three to one (3:1) of a conventional prior art pump.

The manually actuated pumps of the present invention may operate at a high pressure in the pump chamber 105 due to the resilient sliding seal 110. The body 30 may be constructed to accommodate a high pressure in the pump chamber 105. The cylindrical piston skirt 93 is resiliently biased outwardly into engagement with the substantially cylindrical body surface 34A of the body 30. As the pressure increases with the pump chamber 105, the pressure acts upon the seal 110 to increase the force of engagement of the seal 110 with the substantially cylindrical body surface 34A of the body 30.

The annular metering passage 150 defined between the cylindrical portion 146 of the second valve element 144 and the cylindrical portion 126 of the stem passage 125 functions as a needle valve for controlling the flow rate of the liquid 12 discharged from the terminal orifice 26. Accordingly, the manually actuated pump 10 may be adapted by altering the diameter of the second valve element 144 and/or the diameter of the cylindrical portion 126 of the stem passage 125 to pump various types of liquids 12 and to have various types of spray characteristics. The altering of the diameter of the second valve element 144 and/or the diameter of the cylindrical portion 126 of the stem passage 125 also varies the back pressure of the manually actuated pump.

The improved manually actuated pump 10 of the present invention is simple to operate by the operator and has superior spraying performance with high flow rates of the product from the terminal orifice. The improved manually actuated pump 10 is suitable for a variety of volumes of liquid discharged from the pump and for a variety of types of liquids discharged from the pump. The flow rate of the manually actuated pump 10 may be adapted to pump various types of liquids 12 for various types of spray characteristics by the selection of the second valve element 144 and the cylindrical portion 126 of the stem passage 125. The improved manually actuated pump 10 has a decreased material cost for the pump and is easy to manufacture. Although the manually actuated pump 10 has been shown as a vertical action pump with a finger actuator 25, it should be understood that the present invention may be incorporated into a trigger pump of various configurations or other types of manually actuated pumps.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved one-way valve for a manually actuated pump for dispensing a volume of liquid from a container, comprising in combination:

a body having a first and a second body end having an internal body surface defining an internal body region;

a portion of said internal body surface defining a substantially cylindrical body surface;

securing means for securing said body to the container;

a duct extending from said first end of said body into said internal body region of said body;

said duct having an external duct surface and an internal duct surface defining a duct conduit communicating with said internal body region of said body;

a piston having a first and a second piston portion with said first piston portion disposed within said internal body region of said body and with at least a portion of said second piston portion being disposed external to said internal body region of said body;

spring coacting between said body and said piston for biasing said piston into an extended position;

said first portion of said piston being substantially cylindrical to slidably seal with said substantially cylindrical body surface for defining a pump chamber:

an induction tube receivable within said duct conduit for providing fluid communication between the liquid within the container and said pump chamber:

a first one-way valve disposed within said duct conduit for enabling the flow of the liquid only from the container into said pump chamber;

said second piston portion defining a piston stem having a first stem end disposed within said body and a second stem end disposed external to said body with a stem passage extending therebetween;

a second one-way valve disposed in proximity to said stem passage for enabling the flow of the liquid only from said pump chamber into said stem passage of said piston stem;

an actuator having a terminal orifice communicating with said stem passage of said piston stem;

said actuator discharging a volume of the liquid from the container through said terminal orifice upon a longitudinal movement of said actuator from said extended position to a retracted position by an operator said second one-way valve comprising said first stem of said piston stem defining a second valve seat and a second valve element being movable within said stem passage, and biased into engagement with said second valve seat;

said second valve element defining a first and a second end with said second end having a respite for receiving a helical spring therein;

said helical disposed in said respite for biasing said second valve element into engagement with said second valve seat; and said helical spring having a helical pitch for substantially totally collapsing when said second valve element is displaced from said second valve seat for occupying a substantial volume of said respite.

2. An improved one-way valve for a manually actuated pump as set forth in claim 1, wherein said duct is integrally formed with said body.

3. An improved one-way valve for a manually actuated pump as set forth in claim 1, wherein said first one-way valve comprises said duct defining a terminal duct end;

said duct conduit having an enlarged region proximate to said terminal duct end defining a first vane seat; and a first valve element being movable within said enlarged region for engagement with said first valve seat for enabling the flow of the liquid only from the container into said pump chamber.

4. An improved one-way valve for a manually actuated pump as set forth in claim 1, wherein said first one-way valve comprises said duct defining a terminal duct end;

said duct conduit having an enlarged region proximate to said terminal duct end defining a first valve seat;

a first valve element being movable within said enlarged region for engagement with said first valve seat for enabling the flow of the liquid only from the container into said pump chamber; and said first valve element comprising a ball valve element movable for engagement with said first valve seat for enabling the flow of the liquid only from the container into said pump chamber.

5. An improved one-way valve for manually actuated pump as set forth in claim 1, wherein said actuator is secured to said second end of said piston stem; and said actuator enclosing said second end of said piston stem for maintaining said second valve element proximate to said piston stem.

6. An improved one-way valve for a manually actuated pump for dispensing a volume of liquid from a container comprising in combination:

a body having a first and a second body end having an internal body surface defining an internal body region;

a portion of said internal body surface defining a substantially cylindrical body surface;

securing means for securing said body to the container;

a duct extending from said first end of said body into said internal body region of said body;

said duct having an external duct surface and an internal duct surface defining a duct conduit communicating with said internal body region of said body;

a piston having a first and a second piston portion with said first piston portion disposed within said internal body region of said body and with at least a portion of said second piston portion being disposed external to said internal body region of said body;

a spring coacting between said body and said piston for biasing said piston into an extended position;

said first portion of said piston being substantially cylindrical to slidably seal with said substantially cylindrical body surface for defining a pump chamber;

an induction tube receivable within said duct conduit for providing fluid communication between the liquid within the container and said pump chamber;

first one-way valve disposed within said duct conduit for enabling the flow of the liquid only from the container into said pump chamber;

said second piston portion defining a piston stem having a first stem end disposed within said body and a second stem end disposed external to said body with a stem passage extending therebetween;

a second one-way valve disposed in proximity to said stem passage for enabling the flow of the liquid only from said pump chamber into said stem passage of said piston stem;

an actuator having a terminal orifice communicating with said stem passage of said piston stem;

said actuator having a terminal orifice communicating with said stem passage of said piston stem;

said actuator discharging a volume of the liquid from the container through said terminal orifice upon a longitudinal movement of said actuator from said extended position to a retracted position by an operator;

said second one-way valve comprising said first stein end of said piston stem defining a second valve seat and a second valve clement being movable within said stem passage and biased into engagement with said second valve seat;

said second valve element defining a first and a second end with said first end having a valve projection extending from said first end of said piston stem for enabling said valve projection to engage a surface when said piston is moved in proximity to said retracted position to open said second one-way valve for releasing compressed air within said pump chamber for priming the manually operated pump:

said second end of said second valve element having a respite for receiving a helical spring therein for biasing said second valve element into engagement with said second valve seat; and said projection being identical to said respite for enabling; projection to be interchanged with said respite during assembly of the manually operated pump.

7. An improved one-way vane for a manually actuated pump as set forth in claim 6, wherein said duct is integrally formed with said body.

8. An improved one-way valve for a manually actuated pump as set forth in claim 6, wherein said first one-way valve comprises said duct defining a terminal duct end;

said duct conduit having an enlarged region proximate to said terminal duct end defining a first valve seat; and a first valve element being movable within said enlarged region for engagement with said first valve seat for enabling the flow of the liquid only from the container into said pump chamber.

9. An improved one-way valve for a manually actuated pump as set forth in claim 6, wherein said first one-way valve comprises said duct defining a terminal duct end;

said duct conduit having an enlarged region proximate to said terminal duct end defining a first valve seat;

a first valve element being movable within said enlarged region for engagement with said first valve seat for enabling the flow of the liquid only from the container into said pump chamber; and said first valve element comprising a ball valve element movable for engagement with said first valve seat for enabling the flow of the liquid only from the container into said pump chamber.

10. An improved one-way valve for a manually actuated pump as set forth in claim 6 wherein said actuator is secured to said second end of said piston stem; and said actuator enclosing said second end of said piston stem for maintaining said second valve element proximate to said piston stem.

* * * * *

UNITED STATES PATENT AND TRADEMARK OFFICE

CERTIFICATE OF CORRECTION

PATENT NO. : 5,505,343

DATED : April 9, 1996

INVENTOR(S) : Michael G. Knickerbocker

It is certified that error appears in the above-identified patent and that said Letters Patent is hereby corrected as shown below:

Column 1, line 66, delete "an" and insert therefore --art--.

In the Claims

Claim 1, column 19, line 26, after "helical" insert --spring--.

Claim 3, column 19, line 40, delete "vane" and insert therefore --valve--.

Claim 6, column 20, line 49, delete "stein" and insert therefore --stem--.

Claim 6, column 20, line 51, delete "clement" and insert therefore --element--.

Signed and Sealed this

Sixth Day of August, 1996

Bruce Lehman

*Attest:*

BRUCE LEHMAN

*Attesting Officer*

*Commissioner of Patents and Trademarks*